US009371663B2

(12) United States Patent
Pereira et al.

(10) Patent No.: US 9,371,663 B2
(45) Date of Patent: Jun. 21, 2016

(54) INTERNALLY KEYED EXTRUDED MAST SYSTEM

(71) Applicant: US Tower Corporation, Lincoln, KS (US)

(72) Inventors: Kenneth Pereira, Woodlake, CA (US); Jason Timothy Wadlington, Visalia, CA (US)

(73) Assignee: US Tower Corporation, Lincoln, KS (US)

( * ) Notice: Subject to any disclaimer, the term of this patent is extended or adjusted under 35 U.S.C. 154(b) by 0 days.

(21) Appl. No.: 14/705,754

(22) Filed: May 6, 2015

(65) Prior Publication Data

US 2015/0322687 A1 Nov. 12, 2015

Related U.S. Application Data

(60) Provisional application No. 61/989,568, filed on May 7, 2014.

(51) Int. Cl.

| | |
|---|---|
| ***E04B 7/16*** | (2006.01) |
| ***E04H 12/18*** | (2006.01) |
| ***E04H 12/08*** | (2006.01) |
| *F03D 11/04* | (2006.01) |

(52) U.S. Cl.

CPC ..... *E04H 12/182* (2013.01); *E04H 12/085* (2013.01); *F03D 11/04* (2013.01)

(58) Field of Classification Search

CPC ... E04H 12/182; E04H 12/085; Y02E 10/728; F03D 11/04; F05B 2230/604; F05B 2250/11; F05B 2250/141; A47B 9/20; A47B 2220/0025; F16B 7/10

USPC ..... 52/67

See application file for complete search history.

(56) References Cited

U.S. PATENT DOCUMENTS

| | | | | |
|---|---|---|---|---|
| 3,034,209 | A | 5/1962 | Bianca et al. | |
| 3,688,455 | A | 9/1972 | Zebuhr | |
| 4,062,156 | A | 12/1977 | Roth | |
| 4,254,423 | A | 3/1981 | Reinhard | |
| 4,337,601 | A | 7/1982 | Vaerk et al. | |
| 4,357,785 | A * | 11/1982 | Eklund | E04H 12/182 212/350 |
| 4,358,915 | A | 11/1982 | Pantalone | |
| 4,663,900 | A * | 5/1987 | Rehm | H01Q 1/10 212/292 |
| 4,871,138 | A | 10/1989 | Sauter | |
| 5,163,650 | A | 11/1992 | Adams et al. | |
| 5,218,375 | A | 6/1993 | Hillman | |

(Continued)

*Primary Examiner* — Syed A Islam
*Assistant Examiner* — Omar Hijaz
(74) *Attorney, Agent, or Firm* — Leech Tishman Fuscaldo & Lampl; Kenneth D'Alessandro, Esq.

(57) ABSTRACT

An extruded mast section for a telescoping tower includes a hollow extrusion having an exterior surface and an interior surface, and a plurality of spaced apart axially aligned internal screw bosses running the length of the mast section. A telescoping tower assembly includes a first extruded mast section having an exterior surface and an interior surface and a plurality of spaced apart axially aligned internal screw bosses running the length of the first mast section along the interior surface. A second extruded mast section disposed within the first mast section has a plurality of spaced apart axially aligned internal screw bosses running the length of the second mast section along the interior surface. Support collars are disposed at the top and bottom ends of the second mast section each having keyways disposed around its outer perimeter and aligned with a different one of the screw bosses of the first extruded mast section.

6 Claims, 7 Drawing Sheets

(56) References Cited

U.S. PATENT DOCUMENTS 5,249,881 A * 10/1993 Austin, Jr. ..... F16B 7/14 403/109.5
5,537,125 A 7/1996 Harrell, Jr. et al.
5,540,017 A * 7/1996 Eilam ..... B64G 1/222 248/188.5
5,557,982 A 9/1996 Voss et al.
5,593,129 A 1/1997 Adams et al.
5,615,855 A 4/1997 Marue et al.
5,624,046 A 4/1997 Zimmermann
5,660,495 A 8/1997 Atsukawa
5,887,841 A 3/1999 Newberg
RE37,559 E 2/2002 Marue et al.
6,705,239 B2 * 3/2004 Doyle ..... A47B 9/04 108/147
7,062,221 B1 6/2006 Christensen
8,413,390 B2 4/2013 Pereira
8,522,511 B2 * 9/2013 Thoren ..... E04H 12/182 52/118
8,549,812 B1 * 10/2013 Peng ..... E04B 1/34305 212/348
8,827,220 B2 * 9/2014 Eriksen ..... F16B 12/42 108/158
2006/0145036 A1 * 7/2006 Jones ..... A47B 9/00 248/188.5
2006/0150572 A1 * 7/2006 Rawson-Harris ..... E01F 9/0118 52/848
2006/0236648 A1 10/2006 Grundman et al.
2008/0121150 A1 * 5/2008 Picchio ..... A47B 9/04 108/147.19
2009/0300996 A1 * 12/2009 Jones ..... E04C 3/30 52/40
2012/0311948 A1 * 12/2012 Hangel ..... B66C 1/66 52/295
2015/0089901 A1 * 4/2015 Chan ..... E04H 12/003 52/848
2015/0164218 A1 * 6/2015 Bonuccelli ..... A47B 9/20 108/147.19

* cited by examiner

INTERNALLY KEYED EXTRUDED MAST SYSTEM

CROSS-REFERENCE TO RELATED APPLICATIONS

The present application claims priority from U.S. Provisional Patent Application Ser. No. 61/989,568, filed May 7, 2014, the contents of which are incorporated in this disclosure by reference in their entirety.

BACKGROUND

This invention relates to telescoping masts for radio antennas, flood lights and the like. In another respect the invention pertains to portable telescoping masts that are specially adapted for quick and reliable operation under extreme environmental conditions. In yet another respect the invention relates to such portable masts, which can be extended, used, and retracted with improved convenience and safety.

Telescoping masts have been widely employed for radio antennas, lights and a variety of other fixtures. Such masts have been operated by a variety of mechanism, including winches, hydraulic systems and the like. More recently, telescoping masts have been devised which use an axial screw mechanism for raising and lowering the mast sections. For example, an axial screw operated mast is disclosed in U.S. Pat. No. 4,062,156. Another example is disclosed in U.S. Pat. No. 8,413,390, assigned to the same assignee as the present application.

When telescoping masts are used under extreme environmental conditions and particularly in military or other portable operations, it is highly desirable that the masts be ruggedly constructed and be extremely fast, reliable, and safe to operate. In such portable masts, especially those extended and retracted using axial screw mechanisms such as masts constructed in accordance with U.S. Pat. No. 8,413,390, it is particularly important that the sections are capable of being reliably extended and retracted without twisting or binding so that the mast can be extended to the full desired height and the possibility of accidents and injuries due to one or more of the mast sections failing to extend or retract properly is minimized.

Therefore, there is a need for a new extruded mast system and method for manufacturing such a system that overcomes the disadvantages of the prior art.

SUMMARY

According to one illustrative embodiment of the invention, an extruded mast section for a telescoping tower includes a plurality of spaced apart axially aligned internal screw bosses running the length of the mast section.

DRAWINGS

These and other features, aspects and advantages of the present invention will become better understood with regard to the following description, appended claims, and accompanying drawings where:

DESCRIPTION

Figure 1:
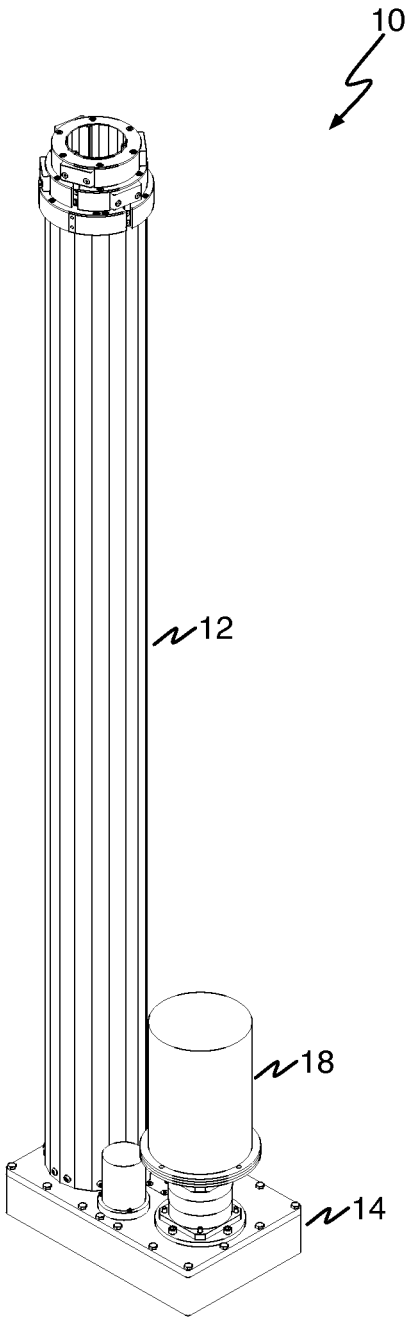
FIG. 1 is an isometric diagram showing a mast system including a plurality of nested extruded mast sections according to the present invention with a section with a top mast section extended.
Figure 2:
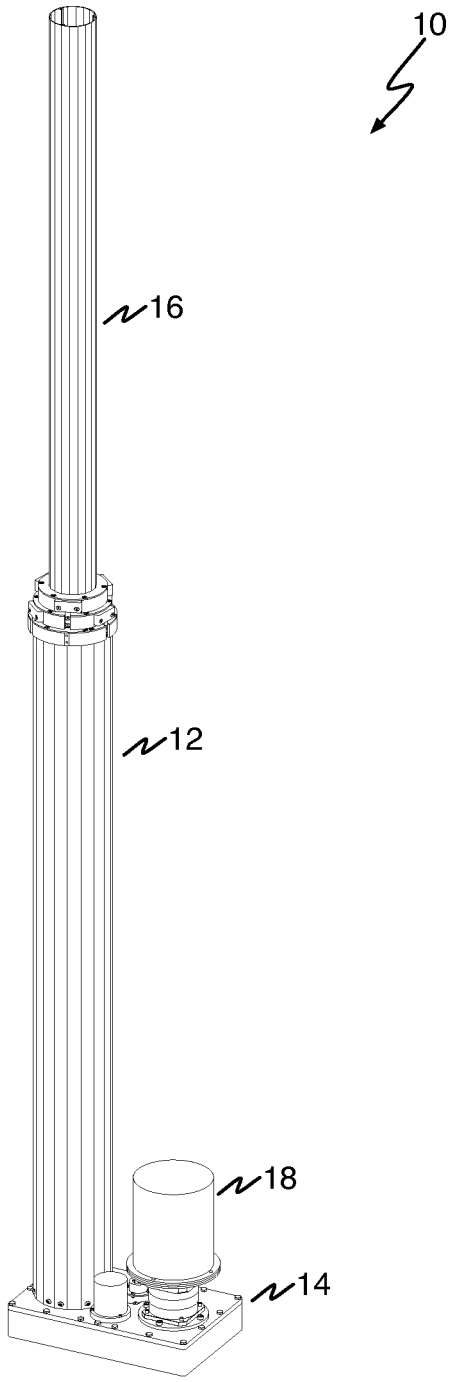
FIG. 2 is an isometric diagram showing a mast system including a plurality of nested extruded mast sections according to the present invention with all sections retracted.

Referring first to FIG. 1, in accordance with one embodiment of the present invention, an internally keyed extruded mast system 10 is depicted and includes a mast bottom section 12 mounted on base 14. The bottom section 12 of internally keyed extruded mast system 10 is shown retracted. FIG. 2 shows internally keyed extruded mast system 10 in a partially extended position where top section 16 extends from mast bottom section 12.

Motor drive unit 18, for extending and retracting the mast sections, is mounted on base 12. One exemplary mechanism for extending and retracting the mast sections is disclosed in U.S. Pat. No. 8,413,390, which is incorporated by reference herein in its entirety. The nested mast sections may be raised using a driving screw arrangement as disclosed, for example, in U.S. Pat. No. 8,413,390.

Figure 3:
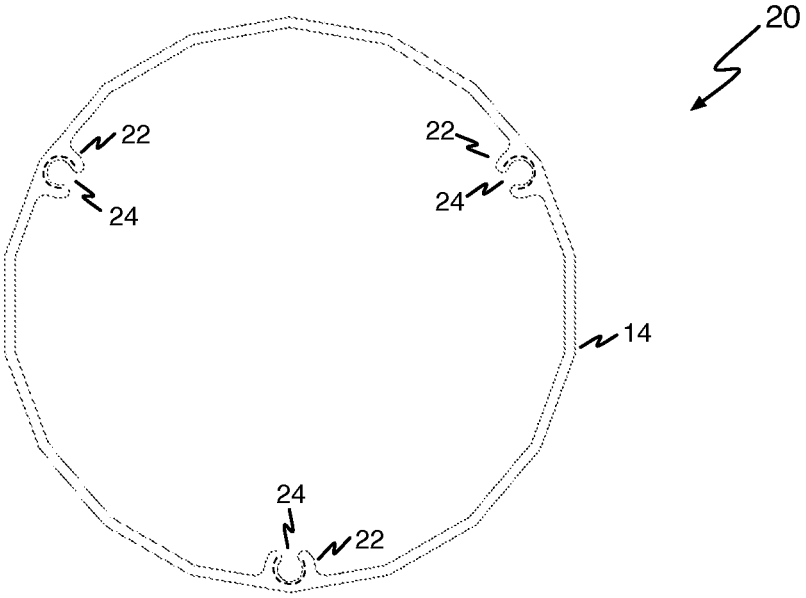
FIG. 3 is an end view of a mast tube section showing a typical arrangement and profile of the internal screw bosses of an extruded mast section according to an exemplary embodiment of the present invention.

Referring now to FIG. 3, a top view of an illustrative mast section 20 is shown. As previously noted, mast section 20 may be circular or polygonal in cross section. Polygonal shapes may increase the strength of the mast section 20 with respect to bending moment force as is known in the art. The illustrative embodiment of FIG. 3 shows the mast 20 formed as an octadecagon (18-sided polygon). Persons of ordinary skill in the art will recognize that masts formed as polygons having other numbers of sides, or other shapes such as circular or oval shapes may be employed in the present invention.

According to one embodiment of the invention, the mast sections can be manufactured from aluminum by an extrusion process. In other embodiments of the invention, the mast sections or from composite materials by a suitable method such as, but not limited to, a pultrusion process.

According to one aspect of the present invention each mast section utilized in the internally keyed extruded mast system 10 of the present invention includes internal screw bosses 22 that are preferably evenly spaced around the circumference of the mast section 20 that run the full length of the tube section. For purposes of illustration, an illustrative mast section 20 is depicted in FIG. 3 and includes three internal screw bosses 22. Each screw boss is integral to the internal wall of each tube section and defines a pilot hole 24 that also runs the length of the tube. The arrangement shown in FIG. 3 allows the mast sections to be formed by an extrusion process.

The design benefit of the internal screw bosses 22 is at least three-fold. For a mast of this nature, it may be desirable or necessary to affix a support collar (one of which is shown at reference numeral 26 in FIG. 4) at both ends of each telescoping mast section. This support collar may be a wear ring, a flange, or some other structure. The screw bosses 22 can be internally threaded to allow mounting of any necessary collar, flange, or other structure at either end of the mast section 20.

Utilization of the screw bosses in this way reduces the amount of time required to manufacture each tube section. Rather than having to make radial penetrations in the tube and then utilizing some form of captive fastener or threaded insert, internal threads are easily created in pilot holes 24 using a standard tap. Internal threads are shown at dashed lines around pilot holes 24 in FIG. 3. Preferably, a minimum of three screw bosses 22 are used in each mast section as shown in FIG. 3.

Figure 4:
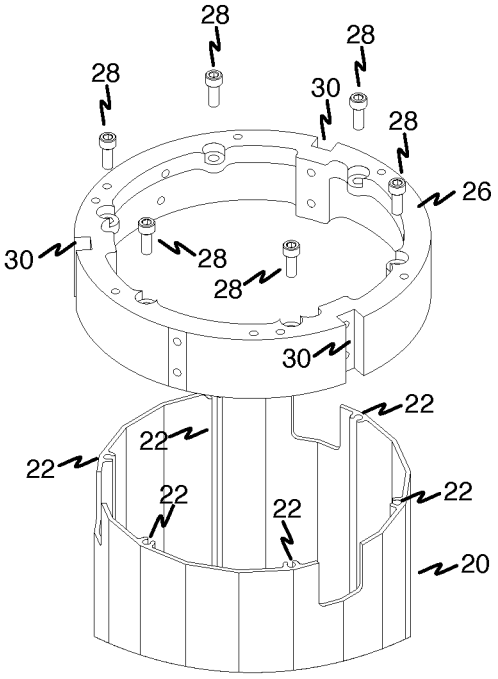
FIG. 4 is an exploded view of an upper portion of a mast tube section and support flange or collar in accordance with an exemplary embodiment of the present invention.

FIG. 4 is an exploded view showing an illustrative embodiment including six screw bosses 22 in mast section 20. Screws 28 are used to fasten the support collar 26 to both the top and bottom ends of the mast section 20. The arrangement of the screw bosses 22 around the internal wall of the tube provide a ribbed structure that functions to improve the strength of the mast section 20, especially in resisting stresses induced on the mast section by an applied bending moment. The placement of the screw bosses 22 ensures that at least two or more screw bosses 22 are located at some distance away from the neutral axis when a moment is being applied to the masts section 20. Placing additional material further away from the neutral axis, in the form of the screw bosses 22, improves the area moment of inertia of the mast section 20 allowing it to better mitigate stress that is applied to it during an applied bending moment.

Figure 5:
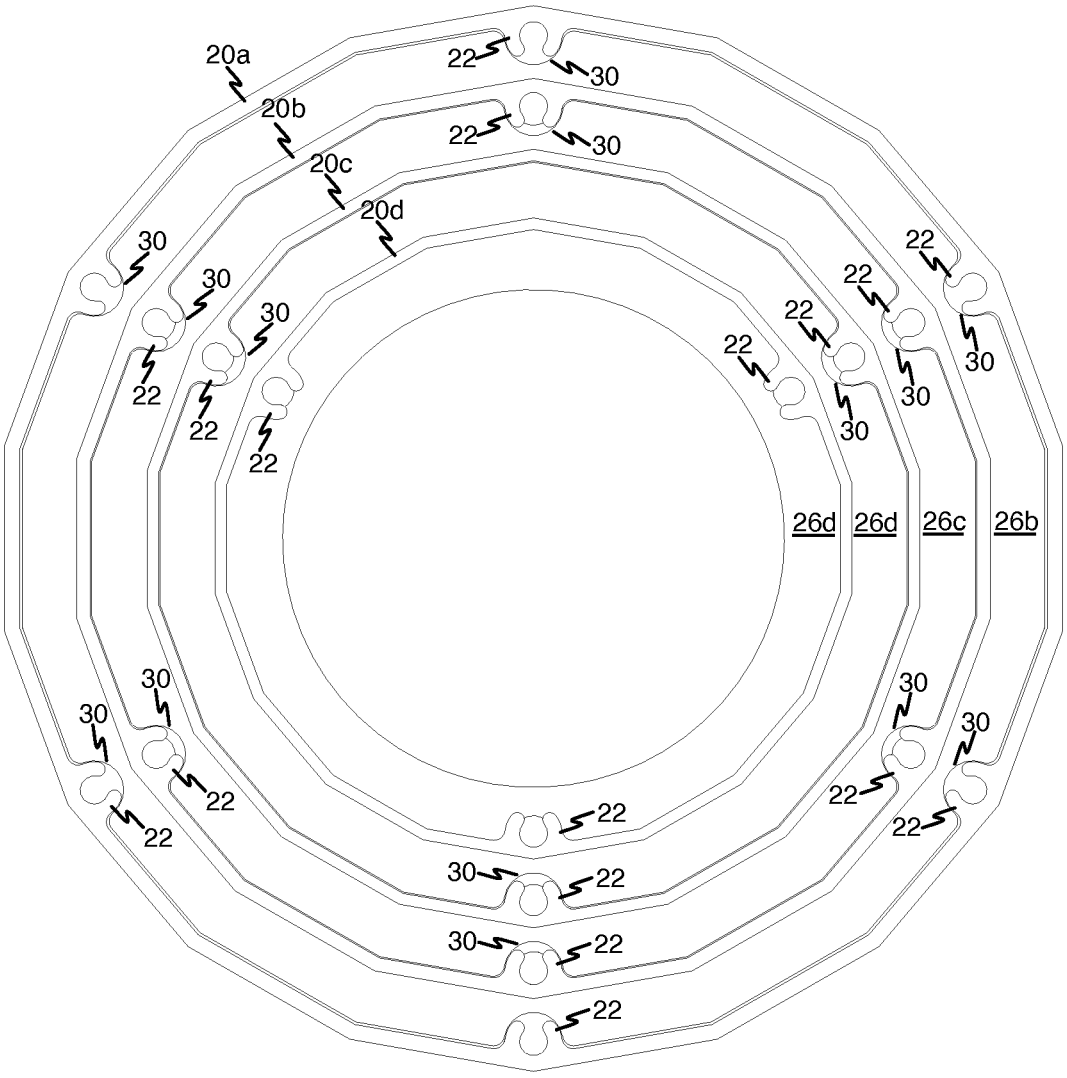
FIG. 5 is a cross-sectional view of four nested mast tubes in an exemplary embodiment of the present invention showing the internal screw bosses acting as keys and support collars providing keyways along which the screw bosses travel.
Figure 6:
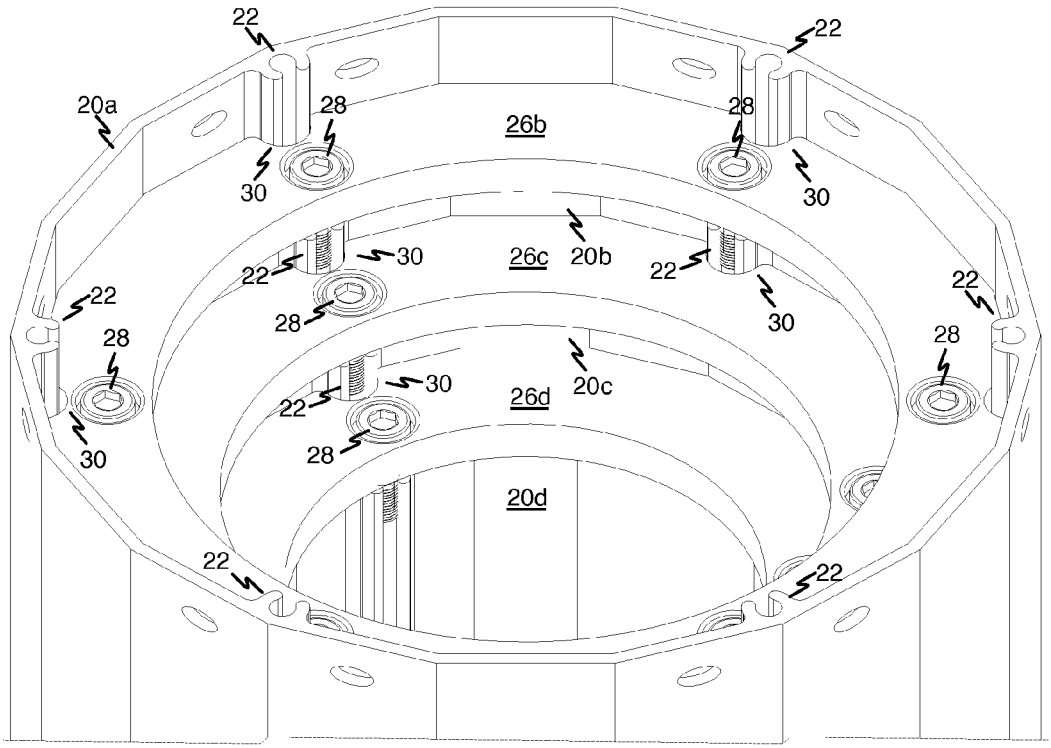
FIG. 6 is a perspective view of four nested mast tubes in an exemplary embodiment of the present invention showing the internal screw bosses acting as keys and support collars providing keyways along which the screw bosses travel.

An additional benefit to the design of the internal screw bosses 22 is that they act as multiple keys to prevent the relative rotation of one tube to the next. This is shown in FIG. 5 and FIG. 6. FIG. 5 is a cross sectional view of an illustrative embodiment of the internally keyed extruded mast system 10 of the present invention and shows four nested mast sections 20*a*, 20*b*, 20*c*, and 20*d*. Bottom support collars 26*a*, 26*b*, 26*c*, and 26*d* are shown in FIG. 5. FIG. 6 is a perspective view showing the bottom end of an illustrative embodiment of the internally keyed extruded mast system 10 of the present invention and also shows four nested mast sections 20*a*, 20*b*, 20*c*, and 20*d*. The support collar for the base section 20*a* has been removed to enable the interaction of the support collars 26*b*, 26*c*, and 26*d* and the screw bosses in tower sections 20*b*, 20*c*, and 20*d* to be more easily seen.

The support collars 26*a*, 26*b*, 26*c*, and 26*d* are provided with external keyways 30 that engage the internal screw bosses of the mast section immediately nested within the mast section 20. As the threaded spindle rotates, the mast section that has its nut engaged with the threaded spindle needs to resist this rotating force. The internal screw bosses accomplish this by allowing the section that is being acted on by the spindle to be keyed to the next outermost section by way of the screw bosses 22 in engagement with the keyways 30. Three such keyways 30 are shown in support collar 26 of FIG. 4.

In FIG. 5 and FIG. 6, each of mast sections 20*b*, 20*c*, and 20*d* is shown with its support collar 26*b*, 26*c*, and 26*d*. The screw bosses 22 of each of mast sections 20*a*, 20*b*, 20*c*, and 20*d* is nested in keyways 30 of the one of the support collars attached to the mast section nested immediately inside of it. In the illustrative embodiment of FIG. 5 and FIG. 6, mast sections 20*a* and 20*b* each have six screw bosses 22 nested in six corresponding keyways of support collars 26*a* and 26*b*. Mast sections 20*c* and 20*d* each have three screw bosses and the screw bosses of mast section 20*c* are nested within the keyways 30 of support collar 26*d* attached to mast section 20*d*.

As shown in FIG. 5 and FIG. 6, this keying effect continues until it reaches the outermost (or base) mast section 20*a*, which is rigidly fastened to some external attachment point. The keying arrangement prevents any of the mast sections 20*b*, 20*c*, and 20*d* from rotating relative to any other mast section or to the external attachment point.

Figure 7:
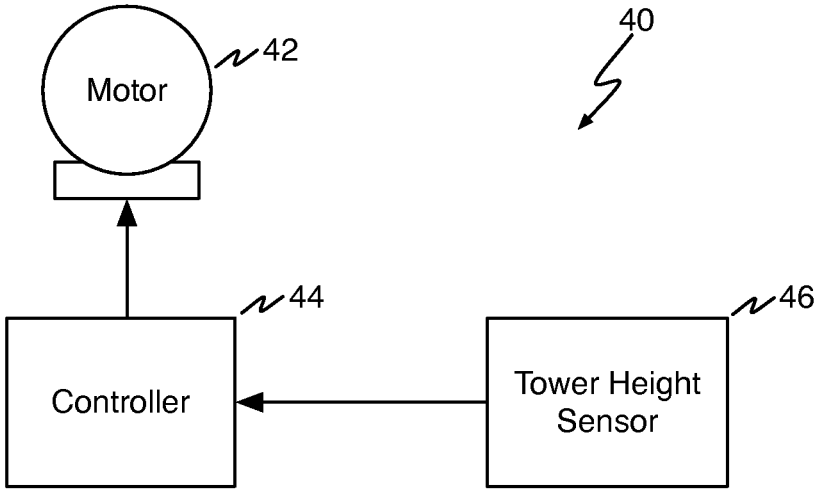
FIG. 7 is a diagram showing an illustrative motor control apparatus in accordance with the present invention.

Referring now to FIG. 7, a block a diagram shows an illustrative motor control apparatus 40 in accordance with another aspect of the present invention. Motor 42 is controlled by motor controller 44. Numerous motor controller configurations that can be used in conjunction with the present invention are well known in the art and the particular details of motor controller 44 are not within the scope of the present disclosure. Motor controller 44 receives data from tower height sensor 46 to control the speed and activation of motor 42. Sensors such as microswitches, hall effect sensors and the like, or rotation counters etc. may be used to perform the function of tower height sensor 46. Tower height sensor 46 sends a signal to motor controller 44 when the tower is close to fully extended or retracted, or when the tower has reached or is close to a predetermined height. Motor controller 44 responds by either turning off the motor 44 or by first slowing the speed of motor 44 and then turning it off as desired for any particular application.

Figure 8:
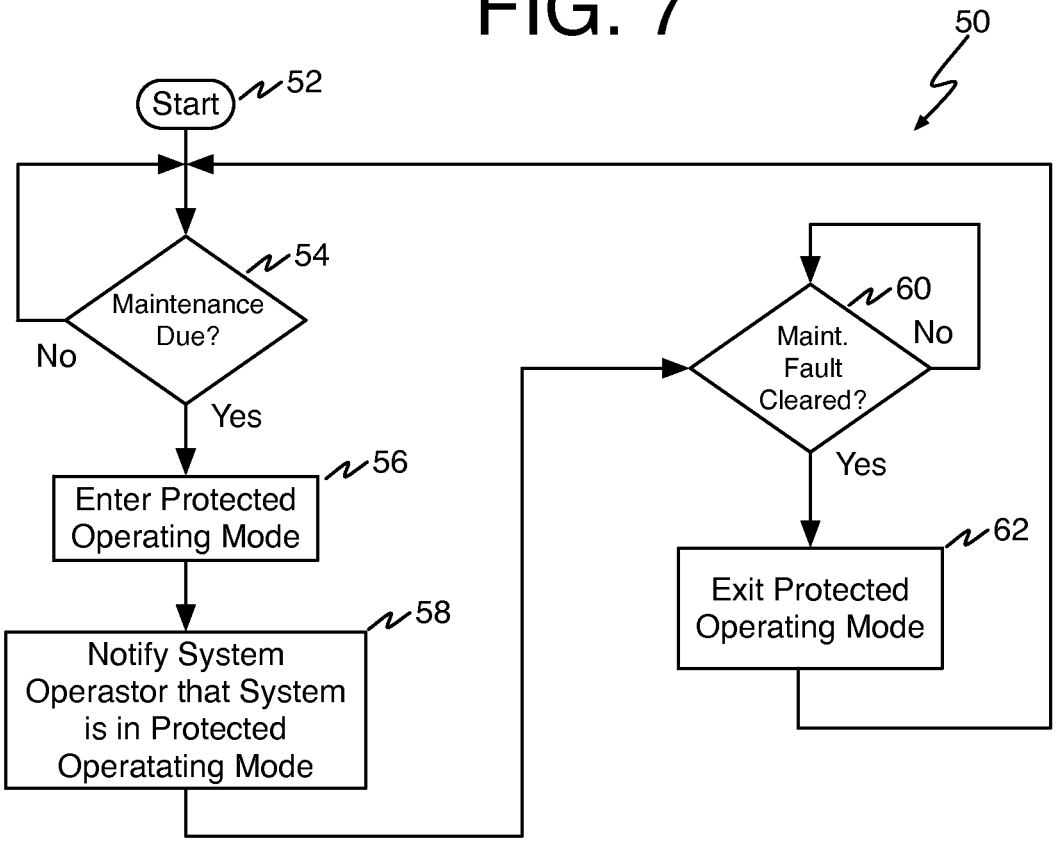
FIG. 8 is a flow diagram showing an illustrative method for employing a protected mode of operation.

FIG. 8 is a flow diagram showing an illustrative method 50 for employing a protected mode of operation. A system for performing the method can easily be implemented using a microcontroller or other controller. Protected modes of operation are useful in numerous situations. For example, protected modes of operation are particularly useful in situations where the tower is deployed in remote locations.

As may be seen from FIG. 8, the method begins at reference numeral 52. At reference numeral 54 the method enters a loop to interrogate whether a maintenance operation is due to be performed on the tower installation. Such maintenance operations may be prescheduled at designated time intervals that can be pre-programmed into the system. The need for a maintenance operation may also be determined from operating parameters of the system such as motor current or temperature, bearing temperature or other suitable indicators based on the nature of the installation. Such maintenance conditions will readily suggest themselves to persons of ordinary skill in the art. Software implementation of such a loop is a routine programming task. As will be appreciated by persons of ordinary skill in the art, other alarm or flag conditions may be used determine the need for maintenance.

At reference numeral 56, the system enters a protected operating mode. When in protected operating mode, the motor controller operates the motor at a lower speed. Other operational restrictions, such as the maxim height to which the tower can be extended, can also be implemented during protected operating mode. Optionally, at reference numeral 58, the system operator can be notified that the system has placed itself into protected operating mode. This can be done via either hardwired communication channel or wirelessly, as is well know in the art.

As illustrated at reference numeral 60, the system will remain in protected operating mode until it is cleared at reference numeral 62. This is usually accomplished on site by a technician who accesses the system controller and clears the protected mode status after performing whatever maintenance has been deemed necessary. After the system has exited protected operating mode, the method returns to reference numeral 52 where maintenance status is again polled or looped, starting the maintenance protection procedure over again.

According to one aspect of the present invention, the mast system utilizes a gearbox designed to accept a variety of external power sources in order to extend and retract the mast. These sources include, but are not limited to, human power, power from a hand-held drill, power from a portable motor or other such devices.

In order to prevent inadvertent movement of the mast it may be necessary to install a brake somewhere between the input shaft and the threaded spindle. In accordance with one embodiment of the present invention, as may be seen in FIGS. 9 and 10, a lock is placed directly on the input shaft to create a simple and cost-effective solution for locking the mast at any desired height and preventing unintended extension or retraction.

Figure 9:
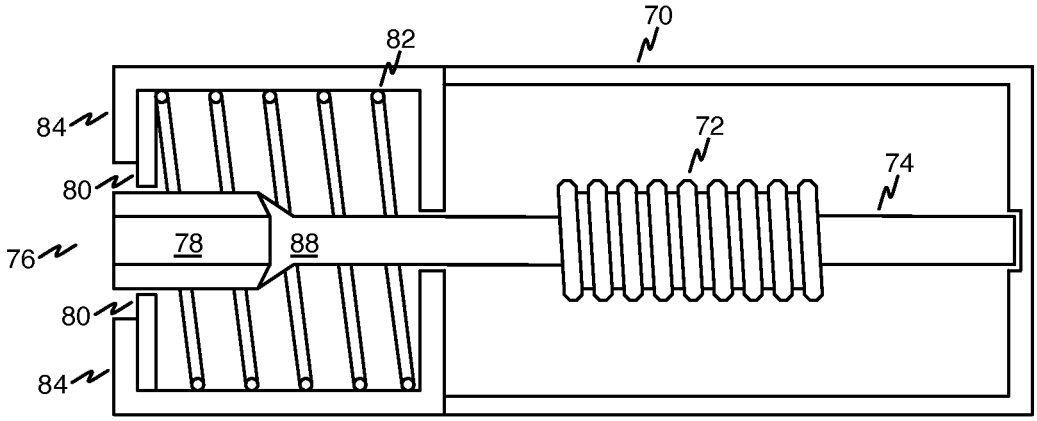
FIG. 9 is a cross-sectional view of a gearbox in its locked condition.

Referring now to FIG. 9, gearbox 70 includes worm gear 72 mounted on worm gear shaft 74. The worm gear 72 rotates a helical gear (not shown) in a conventional manner to extend and retract the tower sections. A first end 76 of shaft 74 includes some feature (for example a hex cross section cavity shown at reference numeral 78) that allows attachment of a tool for rotating the shaft 74 to raise and lower the mast. A non-rotatable locking plate 80 keyed to the gearbox 70 is designed to closely fit over this feature on the input shaft to prevent it from rotating. The locking plate 80 is biased in a locked position by a spring 82 applying a force to bias the locking plate in a locked position against the end wall 84 of the gearbox. In this position, shaft 74 cannot rotate because the locking plate 80 is engaged over the feature 78 on the end 76 of the shaft 74.

Figure 10:
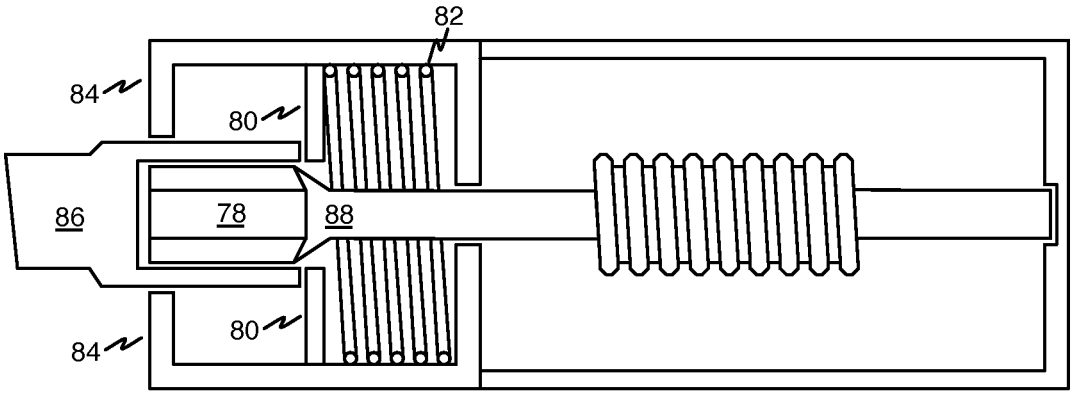
FIG. 10 is a cross-sectional view of a gearbox in its unlocked condition.

As shown in FIG. 10, when extension or retraction of the mast is desired, a tool 86, such as a hex socket is inserted into the housing and engaged on the feature 78 of the end 76 of shaft 74. The tool is urged inward against the locking plate 80, compressing spring 82 and moving the locking plate 68 until it is no longer engaged with the feature input shaft and is disposed around a reduced-diameter portion 88 of shaft 74. At this point, the shaft 74 is able to rotate to cause the mast to either extend or retract.

Figure 11:
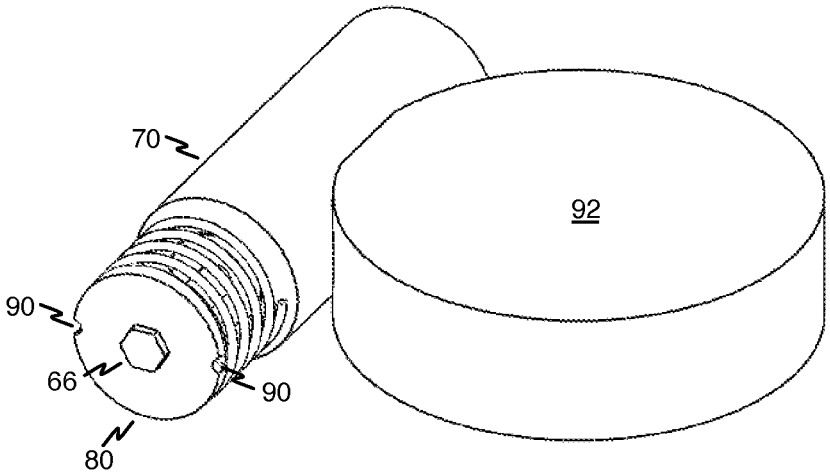
FIG. 11 is an isometric view of the gearbox with the lock housing removed for clarity.

FIG. 11 shows the portion of the gearbox 60 housing worm gear 62, with a portion of the housing removed for clarity, showing an exemplary hex end 78 of shaft 74 as well as locking plate 80 having keys 90 biased by spring 82. Persons of ordinary skill in the art will appreciate that the other portion 92 of the gearbox houses the helical gear (not shown) that engages worm gear 72.

Although the present invention has been discussed in considerable detail with reference to certain preferred embodiments, other embodiments are possible. Therefore, the scope of the appended claims should not be limited to the description of preferred embodiments contained in this disclosure.

What is claimed is:

1. An assembly for a telescoping tower comprising:

a first extruded mast section for the telescoping tower having an exterior surface and an interior surface and a plurality of spaced apart axially aligned internal screw bosses running the length of the first mast section along the interior surface;

a second extruded mast section disposed within the first mast section and having an exterior surface and an interior surface and a plurality of spaced apart axially aligned internal screw bosses running the length of the second mast section along the interior surface;

support collars disposed at top and bottom ends of the second mast section, each having a plurality of keyways disposed around an outer perimeter thereof, each keyway aligned with a different one of the internal screw bosses of the first extruded mast section.

2. The assembly of claim 1, further comprising:

a third extruded mast section disposed within the second mast section and having an exterior surface and an interior surface and a plurality of spaced apart axially aligned internal screw bosses running the length of the third mast section along the interior surface; and support collars disposed at top and bottom ends of the third mast section, each having a plurality of keyways disposed around an outer perimeter thereof, each keyway aligned with a different one of the internal screw bosses of the second extruded mast section.

3. The assembly of claim 2, further comprising:

a fourth extruded mast section disposed within the third mast section and having an exterior surface and an interior surface and a plurality of spaced apart axially aligned internal screw bosses running the length of the fourth mast section along the interior surface; and support collars disposed at top and bottom ends of the fourth mast section, each having a plurality of keyways disposed around an outer perimeter thereof, each keyway aligned with a different one of the internal screw bosses of the third extruded mast section.

4. The assembly of claim 1, wherein the support collars of the second mast section are fastened to the top and bottom ends of the second mast section by screws threaded into the internal screw bosses of the second mast section.

5. The assembly of claim 2 wherein:

the support collars of the second mast section are fastened to the top and bottom ends of the second mast section by screws threaded into the internal screw bosses of the second mast section; and the support collars of the third mast section are fastened to the top and bottom ends of the third mast section by screws threaded into the internal screw bosses of the third mast section.

6. The assembly of claim 3, wherein:

the support collars of the second mast section are fastened to the top and bottom ends of the second mast section by screws threaded into the internal screw bosses of the second mast section;

the support collars of the third mast section are fastened to the top and bottom ends of the third mast section by screws threaded into the internal screw bosses of the third mast section; and the support collars of the fourth mast section are fastened to the top and bottom ends of the fourth mast section by screws threaded into the internal screw bosses of the fourth mast section.

* * * * *